US008931614B2

(12) United States Patent
Senger

(10) Patent No.: US 8,931,614 B2
(45) Date of Patent: Jan. 13, 2015

(54) PASSENGER CONVEYOR WITH MOVABLE LATERAL PANEL MEMBERS

(75) Inventor: Alois Senger, Gresten (AT)

(73) Assignee: Otis Elevator Company, Farmington, CT (US)

( * ) Notice: Subject to any disclaimer, the term of this patent is extended or adjusted under 35 U.S.C. 154(b) by 9 days.

(21) Appl. No.: 13/822,430

(22) PCT Filed: Oct. 8, 2010

(86) PCT No.: PCT/IB2010/002573

§ 371 (c)(1),
(2), (4) Date: Mar. 12, 2013

(87) PCT Pub. No.: WO2012/046091

PCT Pub. Date: Apr. 12, 2012

(65) Prior Publication Data

US 2013/0180822 A1 Jul. 18, 2013

(51) Int. Cl.

| | |
|---|---|
| ***B66B 21/02*** | (2006.01) |
| ***B66B 23/10*** | (2006.01) |
| ***B66B 23/02*** | (2006.01) |
| ***B66B 23/12*** | (2006.01) |
| ***B66B 23/14*** | (2006.01) |

(52) U.S. Cl.

CPC ..... *B66B 23/10* (2013.01); *B66B 23/024* (2013.01); *B66B 23/12* (2013.01); *B66B 23/145* (2013.01)

USPC ..... 198/326; 198/327; 198/333

(58) Field of Classification Search

CPC .. B66B 23/145; B66B 23/028; B66B 23/024; B66B 23/02; B66B 23/08; B66B 23/14

USPC ..... 198/321, 326, 327

See application file for complete search history.

(56) References Cited

U.S. PATENT DOCUMENTS

| | | | | |
|---|---|---|---|---|
| 625,905 | A * | 5/1899 | Souder | 198/327 |
| 4,064,986 | A * | 12/1977 | Bertovich | 198/326 |
| 5,072,821 | A * | 12/1991 | Kruse et al. | 198/327 |
| 5,785,166 | A * | 7/1998 | Hoefling et al. | 198/330 |
| 6,640,957 | B2 * | 11/2003 | Fargo et al. | 198/321 |
| 6,988,608 | B2 * | 1/2006 | Pietz | 198/326 |
| 2007/0137980 | A1 * | 6/2007 | Meyer et al. | 198/327 |
| 2007/0205080 | A1 * | 9/2007 | Streibig et al. | 198/333 |

FOREIGN PATENT DOCUMENTS

| | | |
|---|---|---|
| JP | 7-35237 | 4/1995 |
| JP | 10120351 A | 5/1998 |
| KR | 920007805 B1 | 9/1992 |

OTHER PUBLICATIONS

International Search Report and Written Opinion for related International Application No. PCT/IB2010/002573; report dated Jul. 1, 2011.

* cited by examiner

*Primary Examiner* — James R Bidwell

(74) *Attorney, Agent, or Firm* — Miller, Matthias & Hull LLP

(57) ABSTRACT

The invention relates to a passenger conveyor, comprising an endless transportation band comprising a plurality of transportation elements, at least one endless transportation chain drivably connected to the transportation band, the transportation chain comprising a plurality of transportation chain links, a plurality of transportation chain rollers, consecutive of the transportation chain links being connected via a respective of the transportation chain rollers, and a plurality of transportation chain roller axles, each of the transportation chain roller axles connecting a respective of the transportation elements to the transportation chain, the transportation elements comprising first transportation elements being supported by a respective transportation chain roller axle, and second transportation elements being supported by a transportation element axle.

15 Claims, 6 Drawing Sheets

PASSENGER CONVEYOR WITH MOVABLE LATERAL PANEL MEMBERS

CROSS-REFERENCE TO RELATED APPLICATIONS

Figure 1:
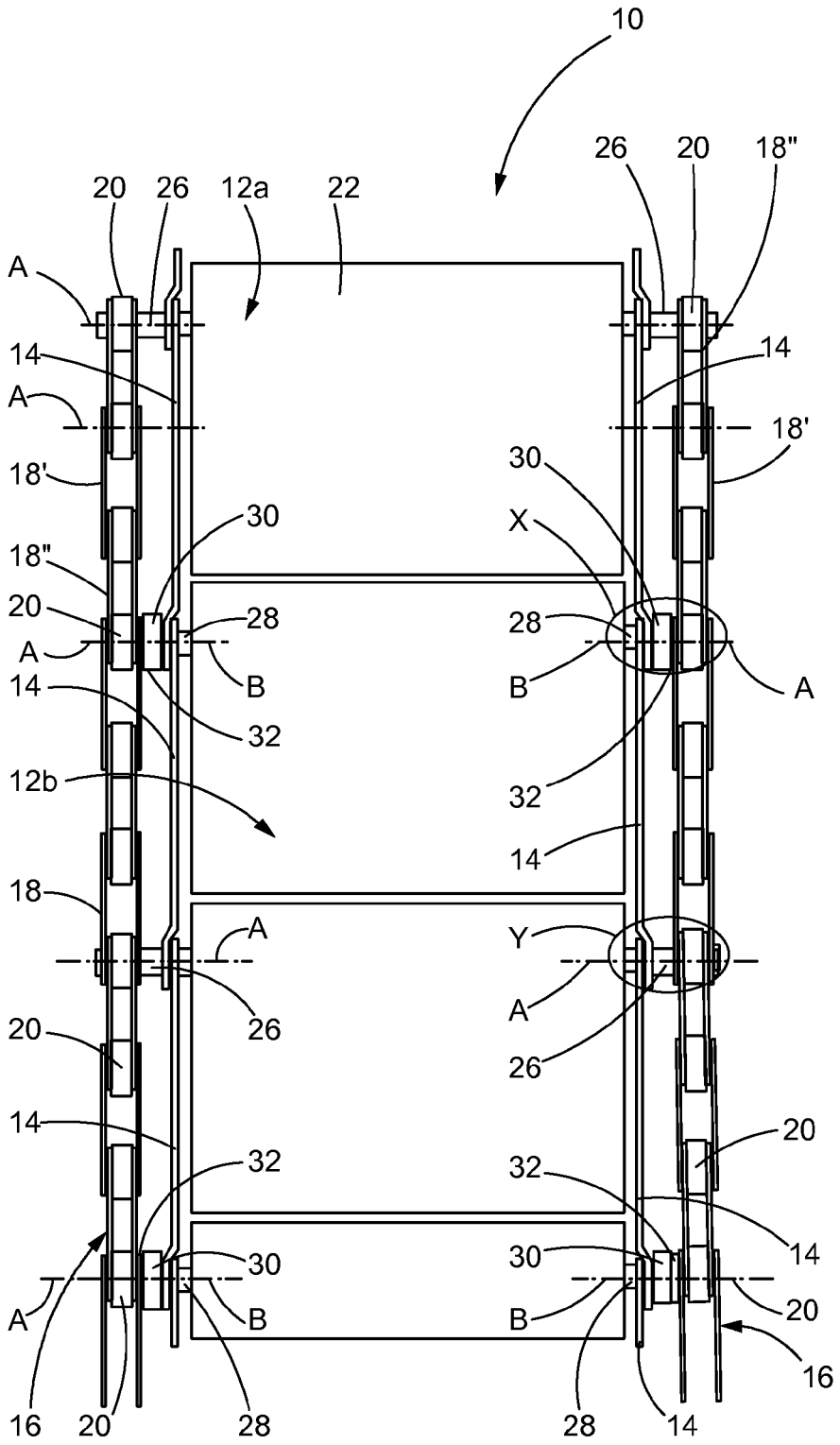

This application is a U.S. national stage filing under 35 USC §371 of International Patent Application No. PCT/IB2010/002573, filed on Oct. 8, 2010.

The present invention relates to a passenger conveyor.

Such passenger conveyors are e.g. escalators or moving walkways. Escalators are passenger conveyors that typically carry passengers between landings at different levels. Moving walkways are usually used to carry passengers along levels extending horizontally or with only slight inclination.

Such passenger conveyor typically includes a frame, balustrades with movable handrails, an endless transportation band (e.g. a step band or pallet band), and a drive system including a transportation chain for propelling the transportation band.

The frame includes a truss section on both left and right hand sides of the frame. Each truss section has two end sections forming landings, connected by an inclined or—in case of a moving walkway—possibly also horizontal midsection. Frequently, one of the landings houses the drive system or machine of the passenger conveyor positioned between the trusses.

The transportation chain travels in an endless way between sheaves or sprockets located at an upstream landing and a downstream landing, respectively. The transportation chain comprises a plurality of transportation chain links, each of the transportation chain links having associated thereto a respective transportation chain roller, consecutive of the transportation chain links being connected via a respective transportation chain roller. The transportation chain elements are guided by a transportation chain guide assembly fixed to the frame.

The present invention particularly pertains to a passenger conveyor with an endless transportation band that is composed of several transportation elements or tread plates (e.g. in the form of steps or pallets). A transportation element includes a tread surface defined by a front side, a rear side and two lateral sides. The transportation band is drivably connected to at least one transportation chain (usually termed step chain or pallet chain). In many cases there are provided two lateral transport chains running in parallel along endless paths and the transportation band is drivably connected to both transportation chains.

In case of a moving walkway travelling between an upstream landing and a downstream landing without significant inclination, it may be more appropriate to say that the transportation band and transportation chain are driven around an upstream and a downstream turnaround section. In case of an escalator the turnaround sections commonly are designated as lower and upper turnaround sections.

The drive system of a passenger conveyor typically comprises the transportation chain, a transportation chain drive wheel (e.g. in the form of a sprocket or toothed wheel), and a drive motor. The transportation chain travels a continuous, closed loop, running from one landing to the other landing, and back. The transportation chain is drivably connected to the transportation elements, e.g. via a transportation chain roller axle which supports a respective transportation chain roller of the transportation chain. The transportation chain roller axle also supports a respective of the transportation elements pivotably. The drive motor drives, directly or via a further transmission, the drive sheave which is in a driving connection with the transportation chain. Commonly the final drive is realized as one or a pair of chain turnaround drive wheels located in a turnaround area. The drive wheels are based on size of the transportation elements and transportation chain and are, as an example, commonly of a 750 mm diameter for most escalator systems. Around each drive wheel a transportation chain is guided and driven.

There also exist passenger conveyors in which propulsion of the transportation chain(s) does not take place in the vicinity of the turnaround sections, but rather in, e.g., the midsections (load section or return section). In passenger conveyors of this type, a turnaround plate or an essentially semicircular guideway may be provided instead of the chain turnaround wheel such that the transportation chain rollers follow the path defined by the turnaround plate or the guideway. The transportation chain rollers are reversed from the load section into the return section of the passenger conveyor in the turnaround plate or the guideway. In this respect, the term turnaround section is intended to cover all types of constructions, e.g. chain turnaround wheels, turnaround guideways or turnaround plates.

The transportation elements of a passenger conveyor, e.g. an escalator or a moving walkway, typically comprise essentially box-shaped elements with a tread surface that is also referred to as the "tread", and a front side that is exposed in the inclined region of the escalator and referred to as the "riser." In case of a moving walkway the riser is typically never exposed to the passenger. The remaining lateral, bottom and rear sides of the box, which also are never exposed to the passenger during operation of the escalator or moving walkway, may also be closed, but frequently remain open. This applies, in particular, to the underside of the transportation element which is situated opposite to the tread surface and to the rear side of the transportation element. The side walls of the transportation element which are directed toward the transportation chain are typically arranged regularly for structural reasons. In instances in which a rear wall of the box-like a transportation element is not provided opposite to the front side, the side walls of the box which are directed toward the transportation chains frequently have a triangular shape that is tapered toward the bottom, and the transportation element itself has only a relatively small thickness in its rear region, by comparison to the thickness of the transportation element in the vicinity of the front side. The weight and the material requirement can be significantly reduced, due to these measures.

Each of the transportation elements is typically fastened to the transportation chain(s) by means of a transportation chain roller axle. The transportation chain roller axle usually extends through the transportation element body and, in case of two transportation chains arranged laterally, is connected to the transportation chains with both of its free ends. The transportation element is customarily manufactured from a material that can be easily processed, for example, a material that can be extruded such as aluminum, an aluminum alloy, or a plastic. The transportation chain roller axle is manufactured from a stronger material, for example, iron or steel.

In the turnaround sections of the passenger conveyor both the transportation chain links as well as the transportation elements must travel along a transition curve in order to reverse their direction of travel. Usually a guiding means is provided in the turnaround sections to guide both the transportation elements and the transportation chain links along the transition curve. Therefore, the bending radius of the transition curve must be chosen in such a way that the larger ones of the transportation elements, and the transportation chain links still can follow the transition curve. For usual size of the transportation elements the transportation elements define the minimum bending radius of the transition curve in the turnaround sections. Hence, such minimum bending radius becomes undesirably large.

In a passenger conveyor, the individual transportation elements typically move in a "channel" that is laterally limited by panel elements that are referred to as the "skirt boards". These skirt boards are rigidly arranged to the frame of the passenger conveyor, with the transportation elements moving relative to these (stationary) skirt boards. The gap formed between the (moving) transportation elements and the (stationary) skirt boards needs to be kept very small for safety reasons, so as to reliably ensure that no objects or body parts of passengers are pulled into this gap and become trapped therein.

The requirement to ensure a very, narrow gap is associated with a high maintenance expenditure. In certain instances, it is entirely impossible to fulfill the safety requirements with respect to a narrow gap. One option for lowering this risk potential, other than with a narrow gap, consists of providing a bottom skirt board panel that is fixedly mounted to the transportation elements and thereby moves together with the transportation elements. Such a movable bottom panel is, e.g., described in U.S. Pat. No. 4,470,497. Such bottom panels according to the prior art have either the disadvantage that they project relatively far upward beyond the tread surface of the transportation element in the horizontal regions of an escalator, e.g., at the entry point and the exit point, or that they have a relatively complicated design.

DE 23 46 266 A1 discloses another approach using pivotable lateral skirt panels. Here, each step of the escalator is connected to the step chain via a respective step chain roller axle, and has mounted thereto a pair of lateral skirt panels. The skirt panels are supported by the step chain roller axles by which the respective step and the steps adjacent to it are connected to the step chain. Thereby, the lateral skirt panels perform a pivot movement with respect to the respective tread surface of the step corresponding to the rising/lowering of the step riser, as the steps travel in the inclined/horizontal sections of the endless transportation path. This construction, however, requires that both the lateral skirt panels and the step chain links have the same length as the tread surfaces of the steps, and in consequence leads to large bending radii in the turnaround sections.

U.S. Pat. No. 6,450,316 B1 discloses an escalator having a construction of lateral panels formed by a combination of circular bottom panels fixedly mounted to the tread surface of each step, and movable bridge parts positioned in between two consecutive of the circular bottom panels. The movable bridge parts are associated with a corresponding link of the step chain and remain stationary thereto, as the step chain travels through different sections of the endless transportation path. Each of the bridge parts has two concave interface edge portions that cooperate with the circular edge portions of adjacent bottom panels, such as to cooperate to provide a continuous barrier along each lateral side of the steps along the escalator travel path. Also this construction requires an allocation of exactly one circular bottom panel and one bridge portion at each lateral side to each step, and in consequence, similar to DE 23 46 266 A1, leads to large bending radii in the turnaround sections.

The above described goal of providing a transition curve with a bending radius as small as possible in the turnaround sections becomes even more challenging in case lateral skirt boards moving together with the transportation elements are to be used, since in addition to space for the transportation elements also space for the lateral skirt boards is needed in the turnaround sections.

It would be beneficial to have available an alternative construction of a passenger conveyor, which construction needs less space, particularly in the turnaround sections of the transportation band. In particular it would be beneficial to allow such solution for a passenger conveyor having transportation elements with lateral panel members providing for sufficient closure of a gap formed at lateral sides of the transporting elements.

Embodiments of the invention provide a passenger conveyor as outlined before, but with an alternative construction of lateral panel members for overcoming the drawbacks of the prior art skirt panel constructions mentioned above.

An embodiment according to the invention provides a passenger conveyor, comprising an endless transportation band comprising a plurality of transportation elements, at least one endless transportation chain drivably connected to the transportation band, the transportation chain being driven around a first and a second turnaround section by means of a drive, the transportation chain comprising a plurality of transportation chain links, a plurality of transportation chain rollers, consecutive of the transportation chain links being connected via a respective of the transportation chain rollers, and a plurality of transportation chain roller axles, each of the transportation chain roller axles connecting a respective of the transportation elements to the transportation chain, the transportation elements comprising first transportation elements being supported by a respective transportation chain roller axle, and second transportation elements being supported by a transportation element axle.

Figure 2:
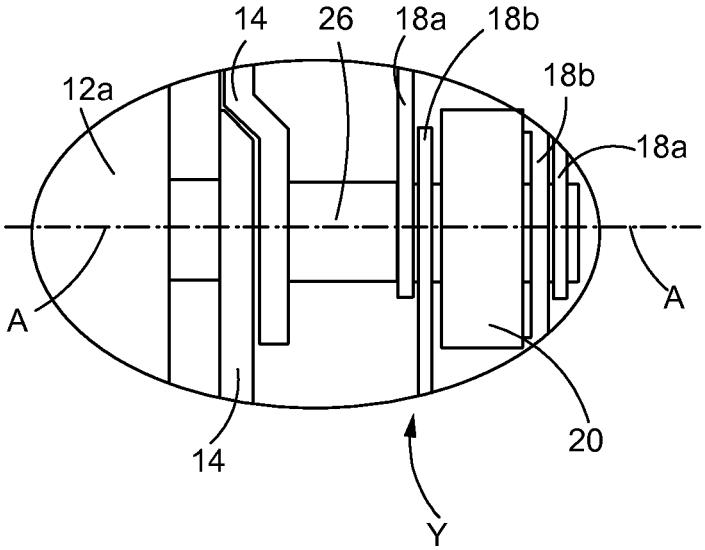
Figure 3:
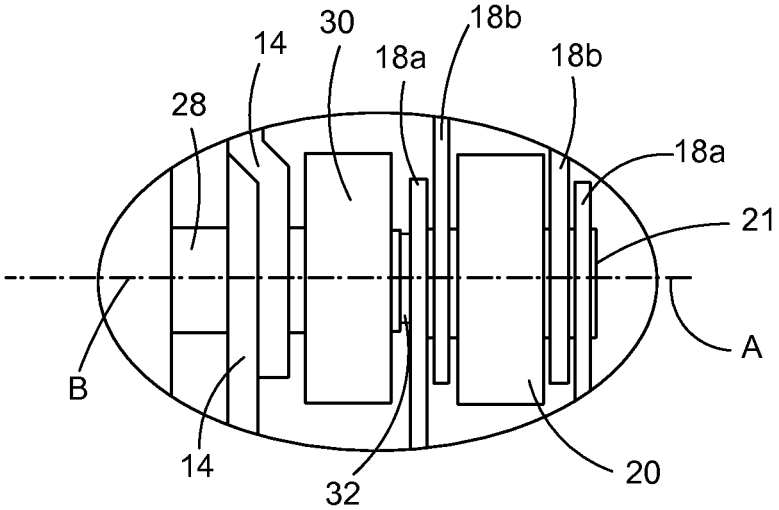
Figure 4:
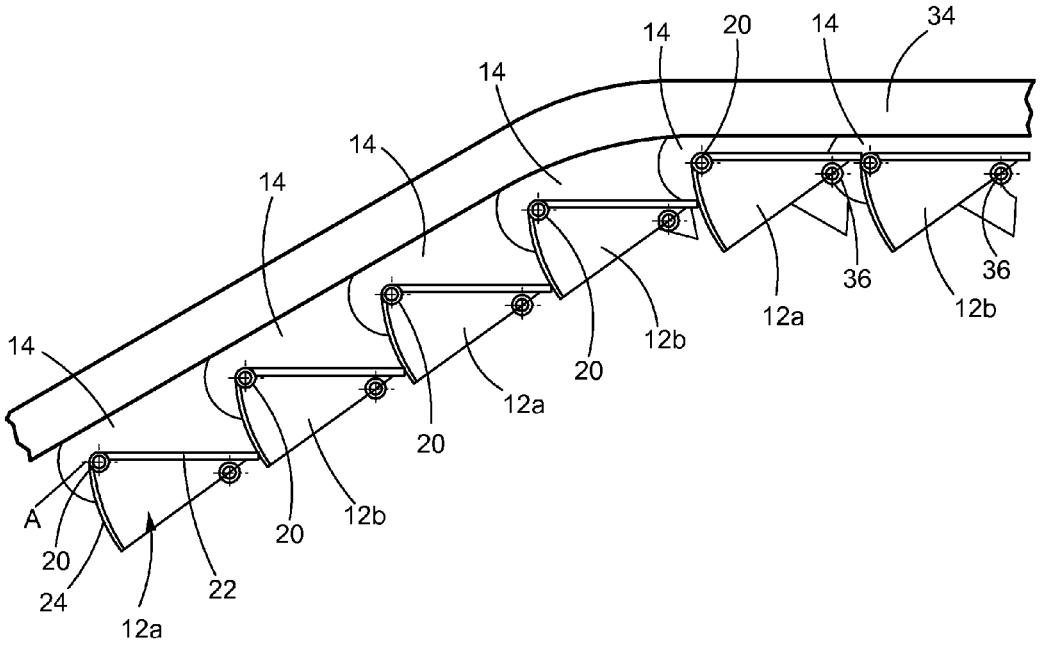
Figure 5:
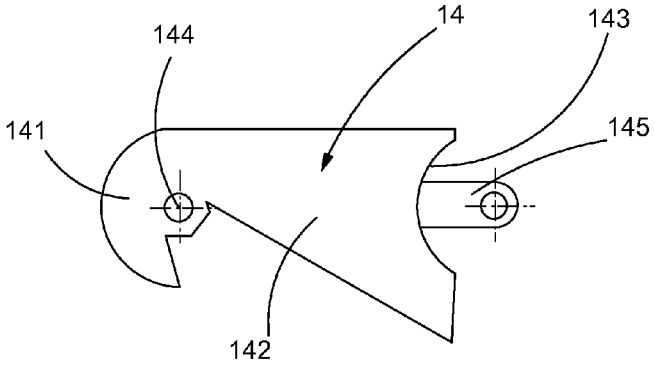
Figure 6:
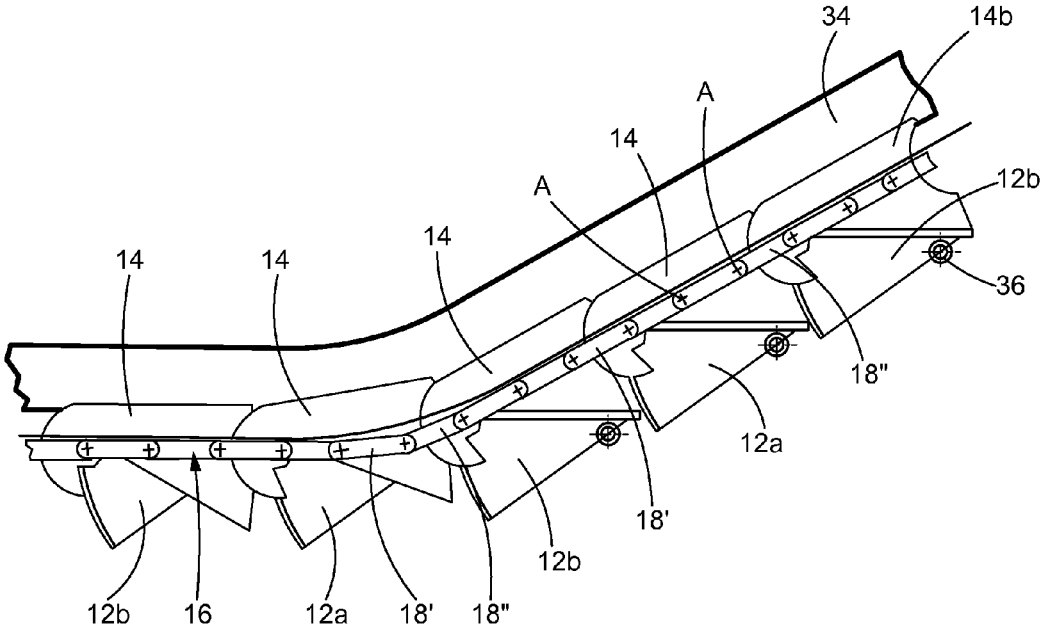
Figure 7:
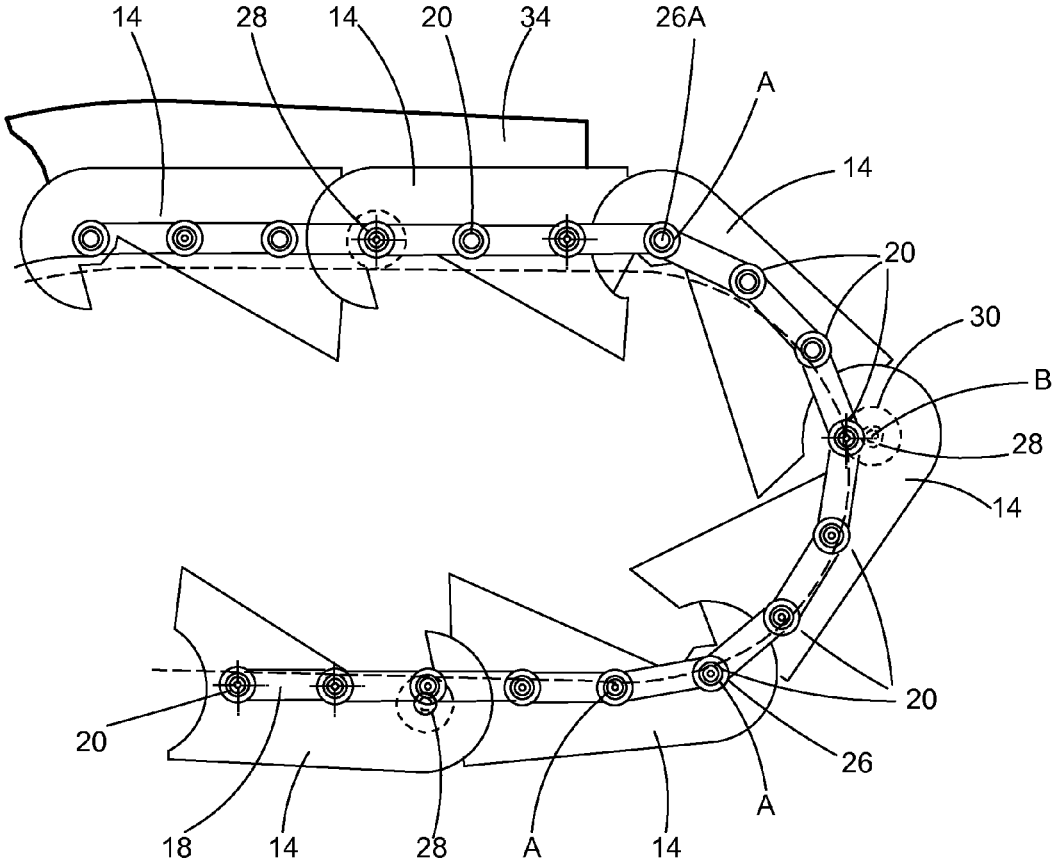
Figure 8:
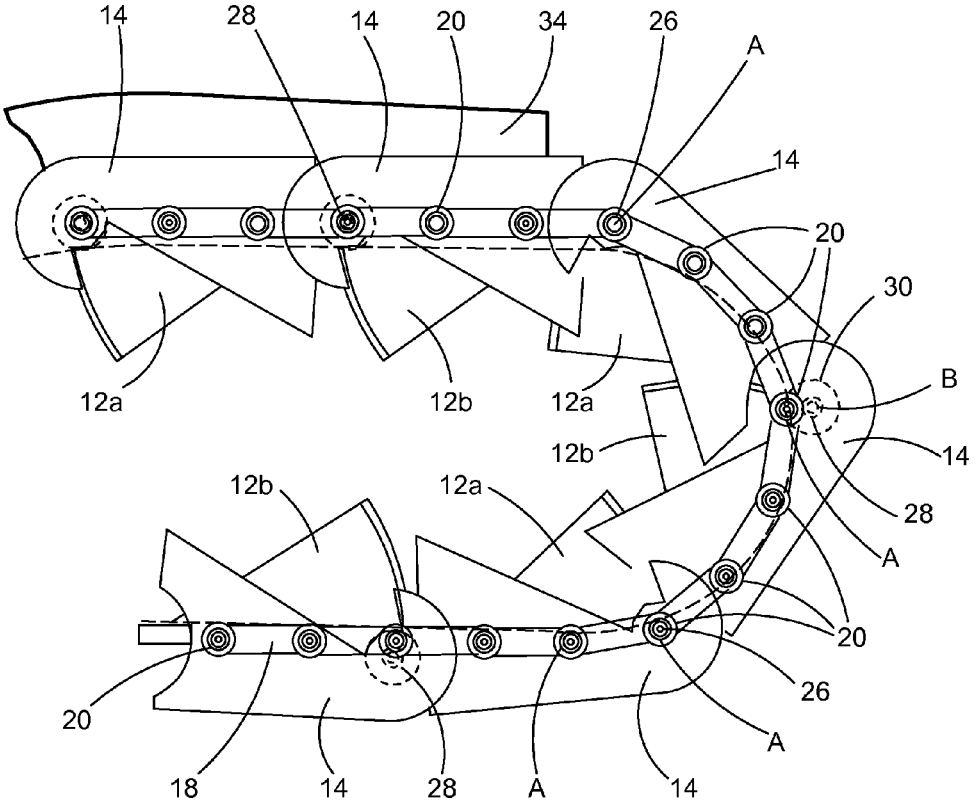

A particular embodiment of the invention will be described in more detail below with reference to the figures, the figures show:

FIG. 1: a plan view of a passenger conveyor in the form of an escalator, according to an embodiment, showing an arrangement of a plurality of consecutive steps or tread plates with corresponding left and right lateral panel members travelling in a straight section of their endless travel path;

FIG. 2: a detail designated by Y in FIG. 1;

FIG. 3: a detail designated by X in FIG. 1;

FIG. 4: in a simplified side view a plurality of consecutive tread plates or steps travelling in the upper transition region of the escalator;

FIG. 5: a single lateral panel member as shown in FIG. 4;

FIG. 6: in a simplified side view from the "back side" a plurality of consecutive tread plates or steps travelling in the lower transition region of the escalator;

FIG. 7: in a side view from the "back side" similar to FIG. 6, a plurality of consecutive lateral panel members and a plurality of consecutive links of the step chain travelling in the upper turnaround section of the escalator, with the corresponding tread plates or steps being omitted for better clarity;

FIG. 8: a side corresponding to FIG. 7 including the tread plates or steps of the step band.

FIGS. 1 to 8 show various illustrations of an embodiment in the form of an escalator 10, it being understood that other embodiments, e.g. in the form of moving walkways are possible.

FIG. 1 shows a plan view of the escalator 10 in a straight section of the travel path of the tread plates or steps 12 thereof. From FIG. 1, an arrangement of a plurality of consecutive tread plates or steps 12*a*, 12*b* with corresponding left and right lateral panel members 14 in the form of pivotable lateral skirt boards can be inferred (as will be outlined in more detailed below). In particular, lateral panel members 14 are associated with one or both lateral sides of consecutive steps 12*a*, 12*b*. In the following the reference signs 12 and 14 will be used to generally designate steps and panel members, respectively.

Steps 12*a* and 12*b* differ in the way they are supported on the frame of the escalator: Steps 12*a* are supported via step chain roller axles 26, whereas steps 12*b* are supported via transportation element axles 26, as will be described in more detail below. Otherwise, steps 12*a* and steps 12 may have identical configurations. In the following description steps 12*a* will be described as "first steps" and steps 12*b* will be described as "second steps", it be understood that the first steps 12*a* differ from the second steps 12*b* in the way they are supported via step chain roller axles 26 or transportation element axles 28, respectively.

FIG. 4 shows a side view of a similar form arrangement of a plurality of consecutive lateral panel members 14 travelling in the upper transition section of the escalator 10. FIG. 6 shows, in a cross-sectional side view, an arrangement of a plurality of consecutive lateral panel members 14 travelling in the lower transition section of the escalator 10, and FIGS. 7 and 8 show, also in a cross-sectional side view, an arrangement of a plurality of consecutive lateral panel members 14 and tread plates or steps 12*a*, 12*b* travelling in the upper turnaround section of the escalator 10.

Throughout all Figures, corresponding elements and characteristics are identified by the same reference symbols. Therefore, explanations regarding a specific Figure generally also apply to each other Figure. They are not repeated expressly with respect to all Figures.

FIGS. 1 to 8 show an escalator 1Q with an endless step band that is composed of several interconnected tread plates or steps 12*a*, 12*b*. Steps 12*a* of the step band are connected laterally to a transport or step chain 16. The escalator 10 has two step chains 16 arranged on lateral sides of the steps 12, respectively. The term "laterally" connected to the steps 12 is understood to include embodiments in which the step chains 16 are, seen in a top view, arranged laterally adjacent to the steps 12 of the step band (as seen in FIG. 1), as well as embodiments in which the step chains 16 are, seen in a top view, arranged fully or partly laterally underneath the tread surfaces of the steps 12 of the step band (not depicted).

Each of the step chains 16 comprises of a series of step chain links 18 (alternately, pairs of outer step chain links 18' and pairs of inner step chain links 18"). The step chain links 18 have respective joints at their opposite longitudinal ends. Each two adjacent step chain links 18 are connected pivotably to one another at the respective joints (in the drawings, the pivoting axes of these joints are designated "A"). Step chain rollers 20 that guide the step chain 16 along its endless path of travel in step chain guides fixed to the escalator frame (not depicted) are also supported on these joints.

The escalator 10 is driven by a drive unit (not shown) that may be realized using a toothed drive sprocket meshing with the step chain or using an endless, revolving toothed drive belt meshing with the step chain.

For example, FIGS. 1 and 4 also show that each step 12 comprises a tread surface or "tread" 22 defined by, a front side adjacent to a "riser" 24, a rear side arranged on the tread surface opposite to the front side, and two lateral sides connecting the front side and rear side.

FIG. 1 also shows lateral panel members or skirt panels 14 that move with the steps 12, such as to remain stationary with respect to the corresponding step throughout travel of the step along the endless path. Each step 12 has supported thereto a pair or lateral (left and right) panel members 14. The panel members 14 are supported pivotably with respect to the steps 12, and therefore rise with respect to the tread surface of their corresponding step when the step moves into an inclined section, and lower with respect to the tread surface when the step moves into a horizontal section (i.e., in the upper and lower landing portions).

The first steps 12*a* are connected to the step chains 16 by way of a step chain roller axle 26. The step chain roller axle 26 is arranged in the vicinity of the front side of each step 12*a* and coincides with the axis A of a corresponding joint of the step chain links 18. The step chain roller axle 26 also supports the corresponding step chain rollers 20 on its respective free ends. While in the embodiment a common step chair roller axle 26 is provided for connecting the step 12 to the left and right step chains 16, it can be understood that alternatively two separate step chain roller axles 26 may be provided for the left and right side of the step.

The first steps 12*a* have supported thereto lateral panel members 14. These first lateral panel members 14 are supported by the step chain roller axles 26 by which the corresponding step 12*a* is connected to the step chains 16.

Connection of the first steps 12*a* and of the corresponding lateral panel members 14 to the step chains 16 via step chain roller axles 26 is shown in more detail in FIG. 2 showing a detail designated "Y" in FIG. 1 in enlargement.

The second steps 12*b* are not connected to the lateral step chains 16. Rather such steps 12*b* have pivotably supported thereto lateral panel members 14, by way of a transportation element axle 28. Corresponding to the arrangement of the step chain roller axles 26 to the first steps 12*a*, the transportation element axle 28 is arranged in the vicinity of the front side of each second step 12*b*. When travelling in straight sections of the endless travel path, as depicted in FIG. 1, the transportation element axle 28 is arranged coaxially with the corresponding step chain roller 20 of the step chain 16, and the axis B of the transportation element axle 28 coincides with the axis A of a corresponding joint of the step chain links 18. However, there is no mechanical linkage between the transportation element axle 28 and the corresponding step chain roller 20. Rather, as is more clearly illustrated in FIG. 3, which is a detailed view of the area designated "X" in FIG. 1, there, is a gap 32 between the end of the transportation element axle 28 and the corresponding step chain roller 20. As depicted in FIG. 3 the axle 21 of step chain roller 20 is separated from the transportation element axle 28 via the gap 32.

In the embodiment of FIG. 1, a common transportation element axle 28 is provided for pivotably supporting the lateral panel members 14 on both lateral sides of the second step 12*b*. However, it will be understood that alternatively separate transportation element axles 28 may be provided on the left and right lateral sides of the step.

From FIG. 1 it can be seen that each of the transportation element axles 28 supports a respective transportation element roller 30 at its axial end. The transportation element rollers 30 are engaged in a panel member guide assembly, provided in the stationary frame of the escalator (not shown). Thereby the transportation element rollers 301 can be guided along a path of travel different from the path of travel of the step chain rollers 20. This is important in the turnaround sections of the travel path.

As can be seen in FIG. 1, the transportation element rollers 30 are located laterally inside the step chains 16 with step chain rollers 20. This allows that the path of travel of the transportation element rollers 30 and the path of travel of the step chain rollers 20 cross each other without interference problems (see FIGS. 7 and 8, where the path of travel of the transportation element rollers is indicated by a dashed line and the path of travel of the step chain rollers approximately follows a line connecting the radially "inner" edges of step chain links 18)

FIG. 4 shows a side view from the steps 12 toward one lateral side of the escalator (i.e. a view of the lateral side from the "front"). FIG. 4 shows a number of lateral panel members 14 that move with the steps 12*a*, 12*b*, as well as a stationary balustrade panel 34 that covers the top of the panel members 14 and continues upward. A balustrade (not shown), for example, of glass, may be arranged on the panel 34, with a hand rail (not-shown) traveling along an outer edge of said balustrade essentially synchronously with the step band. FIG. 4 also shows a plurality of step rollers 36 supported by each of the steps 12*a*, 12*b*, respectively. The step rollers 36 provide for correct pivoting of consecutive steps with respect to each other as the steps travel from an inclined section of the travel path into a horizontal section, and vice versa. Throughout the section shown in FIG. 4 the axis A of each of the step chain rollers 20 is almost coincident with the axis B of the corresponding transportation element axle 28 and transportation element roller 30. Therefore, only step chain rollers 20 are visible in FIG. 4.

FIG. 5 shows one of the lateral panel members 14 in detail. All lateral panel members 14 have an identical geometry. The lateral panel member 14 has a front portion 141 in the form of a section of a disc and a main portion 142 of nearly triangular shape. The main portion has a back edge 143 on its side opposite to the front portion 141. The back edge 143 has the form of a sector of a circle of the same radius as the radius of the disc shaped front portion, and is curved concavely. Therefore, a disc-shaped front portion 141 of a consecutive of the panel member 14 can fit into the space left free by the back edge 143 and abut the back edge 143 closely, such that essentially there does not remain any gap open. The shape of the abutting edges in the form of a part of a circumference of a circle allows that the two consecutive panel members 14, 14 can rotate relative to one another around the center of the disc shaped front portion 141 without opening a gap in between their abutting edges.

The front portion 141 includes an opening 144. In case the panel member 14 is a first panel member 14*a*, the corresponding step chain roller axle 26 fits into the opening 144. Alternatively, in case the panel member 14 is a second panel member 14*b*, the corresponding transportation element axle 28 fits into the opening 144. Further, the panel member 14 is provided on its side opposite the front side with a lug 145 having an opening formed in its axial end section. This opening is located at a distance from the back edge 143 corresponding to the radius of the disc shaped front portion 141. Thereby, two consecutive of the panel members 14, irrespective of whether they are first or second panel members 14*a*, 14*b*, can be connected to each other by fitting the axle 26 or 28 by which the adjacent panel member 14 is connected to its respective step (either a step chain roller axle 26 if the adjacent panel member is a first panel member 14*a*, or a transportation element axle 28 if the adjacent panel member is a second panel member 14*b*) into the opening formed in lug 145. In this way the panel members 14 form a chain of interconnected panel members.

FIG. 6 shows a cross-sectional side view from the outer side of the balustrade towards a lateral side of the escalator. In the view of FIG. 6 a plurality of consecutive steps 12*a*, 12*b* with their corresponding lateral panel members 14 travel in the lower transition region of the escalator. Also indicated in FIG. 6 is the step chain 16 with a plurality of step chain links 18 (with alternating pairs of outer step chain links 18' and pairs of inner step chain links 18", connected to each other via step chain rollers 20, shown in FIG. 1). Also in the section of the travel path depicted in FIG. 6, the axes B of the transportation element axles coincide with axes A of the step chain rollers 20, and so only the axes A of the step chain rollers are visible.

FIGS. 7 and 8 show in side views from the outer side of the balustrade, similar to FIG. 6, a plurality of consecutive lateral panel members 14, and a plurality of consecutive links 18 of the step chain travelling in the upper turnaround section of the escalator 10. FIG. 7 only differs from FIG. 8 in that the corresponding steps 12*a*,12*b* shown in FIG. 8 are omitted from FIG. 7 for clarity.

In both FIGS. 7 and 8 it can be clearly seen that the step chain links 18 and step chain rollers 20 follow a first path of travel (in FIGS. 7 and 8 the path of travel of step chain rollers is almost identical to a polygon line formed by the radially "inner" edges of the step chain links 18) as predetermined by a step chain guide assembly (not shown). The first steps 12*a* and corresponding panel members 14 also follow the of path of travel as defined by the step chain guide assembly, because these first steps 12*a* and panel members 14 are also supported by the step chain roller axles 26. However, the second steps 12*b* and their panel members 14 follow a, path of travel different from the path of travel of the step chain rollers 20 because these, second steps 12*b* and their panel members 14 are supported by a transportation element axle 28 supporting a transportation element roller 30.

Travelling of the steps 12*a*, 12*b* together with their respective panel members 14 along a transition curve, like in the upper turnaround section, can be described as follows: Generally, for a chain with given pitch of its chain links, the chain links can follow a transition curve closely only in case the bending radius of the transition curve is larger than a minimum bending radius. Such minimum bending radius will depend on the pitch of the chain links: it will be smaller for smaller pitch of the chain links and will be larger for larger pitch of the chain links.

The step chain 16 has a smaller pitch of its step chain links 18 than the chain of first and second steps 12*a*,12*b* (including their respective lateral panel members 14, note that in FIGS. 7 and 8 only the panel members 14 are shown). In the illustrated example, the pitch of the step chain links 18 is approximately one-third of the pitch of the first and second steps 12*a*, 12*b*. Therefore, to allow both the step chain links 18 and the first and second steps 12*a*, 12*b* to follow the transition curve in the turnaround section closely, in principle the bending radius radius of the transition curve, as defined by the step chain sprocket, would have to be larger than the minimum bending radius for the chain of first and second steps 12*a*, 12*b*. Such bending radius, however, is large and therefore undesired.

In the embodiment, the bending radius of the transition curve in the turnaround section is selected such that the step chain links 18 are able to follow the bending radius closely, but the steps 12*a*, 12*b*, in case they were arranged as a chain with each of the steps 12*a*, 12*b* being an identical chain link, were not able to. To allow the steps 12*a*, 12*b* to still pass the turnaround section, a compensation is achieved by the effect that only the first steps 12*a* are connected to the step chain 16 via a respective step chain roller axle 26, however the second steps 12*b* are supported via the respective rollers 30 on transportation element axles 28. Rollers 30 engage with a guiding means of the escalator frame in the midsections of the endless path only, but not in the turnaround section. Since the transportation element axle 28 is not connected to the step chain 16 (as illustrated by gap 32 in FIG. 3), and in fact is not guided at all in the turnaround section, it can travel along any path around the turnaround section. In the turnaround section, the chain of first and second steps 12*a*, 12*b* has the characteristic of a chain having each second of its chain links, namely the first chain links 12*a*, only engaged with a guiding means. This results in much more flexibility in the turnaround section.

In the embodiments depicted in FIGS. 1 to 8 each second step ("odd numbered steps") is chosen to be of the first type of steps 12*a* which, together with their corresponding panel members 14*a*, are supported by a step chain roller axle 26. Correspondingly, each also each second step ("even numbered steps") is chosen to be of the second type of steps 12*b* which together with their corresponding panel members 14*b* are supported by a transportation element axle 28 disengaged from the step chain. In other embodiments, allocation of the steps to the first type of steps and to the second type of steps may vary.

Further, in the embodiment depicted in FIGS. 1 to 8, the pitch of the transportation band, as defined by the distances between corresponding points of adjacent steps 12, is three times the pitch of the transportation chains 16. In other words, for every step 12 there are three step chain links 18. In case only each second step is chosen to be of the first type of steps 12*b*, therefore only each sixth step chain roller 20 is supported by a step chain roller axle 26. Other embodiments are conceivable as well in which another pitch of the transportation band with respect to the pitch of the step chains will be chosen.

The embodiments disclosed above provide a passenger conveyor with an endless transportation band and a transportation chain, the passenger conveyor having an alternative construction for overcoming the drawbacks of the prior art constructions. Particular embodiments provide a construction of transportation elements in a passenger conveyor that needs less space, particularly in turnaround sections.

In an embodiment there is provided a passenger conveyor, comprising an endless transportation band comprising a plurality of transportation elements, at least one endless transportation chain drivably connected to the transportation band, the transportation chain being driven around first and second turnaround sections, the transportation chain comprising a plurality of transportation chain links, a plurality of transportation chain rollers, consecutive of the transportation chain links being connected via a respective of the transportation chain rollers, and a plurality of transportation chain roller axles, each of the transportation chain roller axles connecting a respective of the transportation elements to the transportation chain, the transportation elements comprising first transportation elements being supported by a respective transportation chain roller axle, and second transportation elements being supported by a transportation element axle.

Typically the transportation band, together with the transportation chain, will be driven around the first and second turnaround sections.

In principle, bending radii of the transportation chain in the turnaround sections could be reduced by using a transportation chain having a smaller pitch, as defined by the distance between the axes of adjacent transportation chain rollers. The smaller the pitch of the transportation chain is, the shorter are the transportation chain links, such that the transportation chain can be guided along a travel path with smaller bending radius. However, in passenger conveyor constructions having a respective panel member supported pivotably at each lateral side of the transportation elements, the lateral panel members are mounted to the transportation chain roller axles of consecutive chain rollers of the transportation chain, and therefore the transportation chain has to travel the same path as the transportation elements and their lateral panel members. For this reason the transportation chain has the same pitch as the transportation elements which defines the minimum possible bending radii in the turnaround sections.

Simply reducing the pitch of the transportation chain with respect to the pitch of the transportation elements, such that transportation chain roller axles which support the transportation elements and their corresponding lateral panel members are associated to each $n^{th}$ (In FIGS. 7 and 8, each $3^{rd}$) transportation chain roller only, by itself, does not bring any advantage, since the sequence of transportation elements connected to the transportation chain via the transportation chain roller axles still cannot be guided along a smaller bending radius.

The present invention suggests a different construction in that only a subset of the transportation elements, called first transportation elements, are supported by transportation chain roller axles which also support transportation chain rollers of the transportation chain. There is another subset of transportation elements, called second transportation elements, which are not supported by transportation chain roller axles, but instead are supported pivotably by their own transportation element axles. First and second transportation elements may be identical, except that first transportation elements are connected to the transportation chain via step chain; roller axles, while second transportation elements do not have any direct connection to the transportation chain. The construction with first and second transportation elements, as described, gives the possibility that the second transportation elements follow a path of travel that may diverge from the path of travel of the first transportation elements. It has been demonstrated that such construction allows to achieve smaller bending radii in the turnaround sections of the passenger conveyor, since the first transportation elements, on the one hand, and the second transportation elements, on the other hand, can follow different paths of travel in the turnaround sections. It can be said that the second transportation elements are allowed to diverge from the path of the first transportation elements, which still follow the path of the transportation chain elements in the turnaround sections.

In conventional passenger conveyor constructions having a respective panel member supported pivotably at each lateral side of the transportation elements, the lateral panel members are mounted to the transportation chain roller axles of consecutive chain rollers of the transportation chain, and therefore the transportation chain has to travel the same path as the transportation elements and their lateral panel members. For this reason the transportation chain has the same pitch as the transportation elements which defines the minimum possible bending radii in the turnaround sections.

The construction with first and second transportation elements is particularly beneficial in case of a passenger conveyor having transportation elements each further comprising at least one panel member located on a lateral side of the transportation element, as described above. The at least one panel member in such constructions may be supported such as to be stationary with respect to the respective transportation element and to be pivotable with respect to the respective transportation element. The panel members associated with first transportation elements, may be supported with respect to the transportation element by a respective transportation chain roller axle. The panel members associated with a second transportation element may be supported with respect to the transportation element by a respective transportation element axle.

In an embodiment, in addition to any of the combinations of features above, each of the transportation element axles may be disengaged from the transportation chain roller of the corresponding transportation chain link, e.g. in such a way that the step chain roller axles extend laterally beyond the transportation element axles. Although in significant parts of the endless travel path of the transportation elements and transportation chain, in particular in straight sections or only slightly curved transition sections, transportation elements and transportation chain will travel a same or parallel path of travel, there is no link between the transportation element axles and the corresponding transportation chain axles, even though the transportation element axles may be aligned coaxial to the transportation chain rollers in such sections. This allows that in sections of the travel path having stronger curvature, in particular in the turnaround sections, a deviation in the alignment of the transportation element axles to the corresponding transportation chain rollers occurs. Such deviation corresponds to the "swivel out" movement of the second transportation elements with their respective second lateral panel members supported thereto.

In an embodiment, in addition to any of the combinations of features above, there is provided a transportation chain guide assembly for guiding the transportation chain along an endless path around the first and second turnaround sections. Such transportation chain guide assembly may be adapted to interact with the transportation chain rollers, such as to guide the transportation chain rollers along an endless path around the first and second turnaround sections. For example the transportation chain may have pairs of inner link members and pairs of outer link members, a pair of inner link members being connected to a pair of outer link members by the transportation chain rollers. The transportation chain guide assembly typically will engage with the radially extended portions of the transportation chain rollers. For the first transportation elements mentioned above, the corresponding transportation chain rollers are supported by a respective transportation chain roller axle.

In further embodiments, in addition to any of the combinations of features above, each of the transportation element axles may support a corresponding transportation element roller. Provision of such transportation element rollers allows for a transportation element guide assembly to interact with the transportation element rollers, such as to guide the transportation element rollers at least along parts of an endless path around the first and second turnaround sections. In general, at least in curved sections of the endless travel path of transportation elements and transportation chain (e.g. in the first and second turnaround sections) the transportation chain guide assembly and the transportation element guide assembly will define different paths of travel for the transportation chain rollers and the transportation element rollers, respectively, and hence the transportation element guide assembly will be different from the transportation chain guide assembly in such sections. In an embodiment, the transportation element rollers may even, travel completely unguided in the turnaround sections. It is, however, conceivable that at least in essentially straight portions of the endless travel path, the transportation element rollers and the transportation chain rollers will travel the same or nearly the same travel path, and so the transportation chain guide assembly can be used to guide the transportation element rollers in such sections.

In an embodiment, in addition to any of the combinations of features above, the transportation element rollers may be located laterally inside of the transportation chain rollers, i.e. closer to the lateral sides of the treads than the transportation chain rollers. In such arrangement the paths of travel of the transportation element rollers and of the transportation chain rollers may cross each other without interference.

In an embodiment, in addition to any of the combinations of features above, n (n being in integer larger than one) of the transportation elements may be connected to the transportation chain via a respective transportation chain roller axle, and m (m being an integer larger than one) of the transportation elements may be supported via a respective transportation element axle. In general n+m will be equal to the total number of transportation elements, such that each transportation element is supported either by a transportation chain roller axle or by a transportation element axle.

E.g. each second or third of the transportation elements may be connected to the transportation chain via a respective transportation chain roller axle. Transportation elements not connected to the transportation chain directly via a transportation chain roller axle will be able to "swivel outwards" with respect to the transportation chain in the turnaround sections. In the particular example where each second transportation element is connected to the transportation chain via a respective transportation chain roller axle every other transportation element will be able to swivel outwards in the turnaround sections.

In an embodiment, in addition to any of the combinations of features above, the pitch of the transportation chain may be significantly smaller than the pitch of the transportation chain roller axles. In other words, the number of transportation chain rollers (or equivalently the number of transportation chain links) may be k times the number of transportation chain roller axles (k being an integer larger than one). In a particular embodiment, only each sixth transportation chain roller may be supported by a transportation chain roller axle. In this way, significant flexibility can be achieved when the transportation elements travel in the turnaround sections. Usually the pitch of the transportation chain will be even smaller than the pitch of the transportation elements. Each transportation element will have associated thereto two or more of the transportation chain links. This allows to reduce the bending radius of the transition curve in the turnaround sections down to a bending radius which allows the transportation chain links to follow the transition curve closely, as the transportation elements are allowed to follow a different path of travel in the turnaround section. In an example, the pitch of the transportation chain may be a third of the pitch of the transportation elements.

In an embodiment, in addition to any of the combinations of features above, each of the transportation elements may comprise a tread surface defined by a front side, a back side and two lateral sides, and wherein the position at which the transportation element is supported by the respective transportation chain roller axle or by the respective transportation element axle is located in the vicinity of the front side of the transportation element. At the front side the tread surface abuts a usually an essentially vertically extending face called "riser".

In a further embodiment, in addition to any of the combinations of features above, a plurality of the panel members may be arranged consecutively in such a way that the sequence of panel members covers an open space extending on a lateral side of the transportation elements between the lower edges of stationary side panel elements and the tread surfaces of the transportation elements.

In a further embodiment, in addition to any of the combinations of features above, a plurality of panel members may be arranged consecutively on each lateral side of the transportation elements. A plurality of consecutive panel members may be arranged on one lateral side of the transportation elements, and a plurality of consecutive panel members may be arranged on the opposite lateral side of the transportation elements, such that a transportation channel is formed by the transportation elements moving in between the lateral panel members.

In a still further embodiment of the passenger conveyor, in addition to any of the combinations of features above, a plurality of the panel members may be arranged consecutively in such a way that an open vertical space extending on a lateral side of the transportation elements along the path of travel of the transportation elements is covered by the sequence of panel members.

The passenger conveyor may further comprise first and second transportation chains running in parallel and located on respective lateral sides of the transportation elements, each of the first and second transportation chains being driven around the first and second turnaround section.

Respective transportation elements assigned to the first subset of transportation elements may be connected to the first and second transportation chains via a (common) transportation chain roller axle.

The invention claimed is:

1. A passenger conveyor, comprising an endless transportation band comprising a plurality of transportation elements, at least one endless transportation chain drivably connected to the transportation band, the transportation chain being driven around first and second turnaround sections, the transportation chain comprising a plurality of transportation chain links, a plurality of transportation chain rollers, consecutive transportation chain links being connected via transportation chain rollers, and a plurality of transportation chain roller axles, each of the transportation chain roller axles connecting a respective of the transportation elements to the transportation chain, the transportation elements comprising first transportation elements being supported by a respective transportation chain roller axle, and second transportation elements being supported by a transportation element axle; and wherein each of the transportation elements further comprises at least one panel member located on a lateral side of the transportation element, the at least one panel member moving with the respective transportation element and being supported pivotably with respect to the respective transportation element.

2. The passenger conveyor according to claim 1, wherein each of the transportation element axles is not connected to the transportation chain roller of the corresponding transportation chain link.

3. The passenger conveyor according to claim 1, further comprising a transportation chain guide assembly for guiding the transportation chain along an endless path around the first and second turnaround sections.

4. The passenger conveyor according to claim 3, wherein the transportation chain guide assembly is adapted to interact with the transportation chain rollers such as to guide the transportation chain rollers along an endless path around the first and second turnaround sections.

5. The passenger conveyor according to claim 1, comprising a plurality of transportation element rollers, each of the transportation element rollers being supported by a respective transportation element axle.

6. The passenger conveyor according to claim 5, comprising a transportation element guide assembly interacting with the transportation element rollers such as to guide the transportation element rollers.

7. The passenger conveyor according to claim 6, wherein, at least in the first and second turnaround sections, the transportation chain guide assembly and the transportation element guide assembly define different paths of travel for the transportation chain rollers and the transportation element rollers, respectively.

8. The passenger conveyor according to claim 1, wherein the transportation element rollers are adapted to move unguided when passing first and second turnaround sections.

9. The passenger conveyor according to claim 5, wherein the transportation element rollers are located laterally inside of the transportation chain rollers.

10. The passenger conveyer according to claim 1, wherein n of the transportation elements are connected to the transportation chain via a respective transportation chain roller axle and m of the transportation elements are supported via a respective transportation element axle, n+m being equal to the total number of transportation elements.

11. The passenger conveyor according to claim 10, wherein each second or third transportation element is connected to the transportation chain via a respective transportation chain roller axle.

12. The passenger conveyor according to claim 1, wherein the number of transportation chain rollers is k times the number of transportation chain roller axles.

13. The passenger conveyor according to claim 12, wherein k=6.

14. The passenger conveyor according to claim 1, wherein each of the transportation elements comprises a tread surface defined by a front side, a back side and two lateral sides, and wherein the position at which the transportation element is supported by the respective transportation chain roller axle or by the respective transportation element axle is located in the vicinity of the front side of the transportation element.

15. The passenger conveyor according to claim 1, wherein the plurality of the panel members are arranged consecutively in such a way that the sequence of panel members covers an open space extending on a lateral side of the transportation elements between the lower edges of stationary side panel elements and the tread surfaces of the transportation elements.

* * * * *